US010316476B2

(12) United States Patent
Marsolek et al.

(10) Patent No.: US 10,316,476 B2
(45) Date of Patent: Jun. 11, 2019

(54) SCREED ASSEMBLY FOR A PAVING MACHINE

(71) Applicant: Caterpillar Paving Products Inc., Brooklyn Park, MN (US)

(72) Inventors: John L. Marsolek, Watertown, MN (US); Luke E. Graham, Clinton, MA (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 22 days.

(21) Appl. No.: 15/095,639

(22) Filed: Apr. 11, 2016

(65) Prior Publication Data

US 2017/0292232 A1 Oct. 12, 2017

(51) Int. Cl.

| | |
|---|---|
| ***E01C 19/42*** | (2006.01) |
| ***E01C 19/48*** | (2006.01) |
| ***E01C 23/14*** | (2006.01) |
| ***E01C 19/23*** | (2006.01) |
| ***E01C 23/01*** | (2006.01) |

(52) U.S. Cl.

CPC ..... *E01C 19/48* (2013.01); *E01C 19/23* (2013.01); *E01C 19/488* (2013.01); *E01C 23/01* (2013.01); *E01C 23/14* (2013.01); *E01C 2301/10* (2013.01)

(58) Field of Classification Search

USPC ..... 404/84.1, 118

See application file for complete search history.

(56) References Cited

U.S. PATENT DOCUMENTS

| | | | | |
|---|---|---|---|---|
| 3,082,460 | A * | 3/1963 | Haivala | E01C 19/44 15/144.1 |
| 3,702,578 | A * | 11/1972 | Davin | E01C 19/42 404/118 |
| 4,650,366 | A * | 3/1987 | Morrison | E01C 19/402 404/114 |
| 5,201,604 | A * | 4/1993 | Ferguson | E01C 19/008 404/110 |
| 5,356,238 | A | 10/1994 | Musil et al. | |
| 5,366,320 | A * | 11/1994 | Hanlon | E01C 19/48 404/118 |
| 5,540,519 | A * | 7/1996 | Weber | E01C 19/402 15/235.4 |
| 5,895,172 | A | 4/1999 | Grembowicz et al. | |
| 5,921,708 | A * | 7/1999 | Grundl | E01C 19/48 180/168 |

(Continued)

FOREIGN PATENT DOCUMENTS

| | | | | |
|---|---|---|---|---|
| DE | 19537691 | | 11/2004 | |
| DE | 102017206050 | A1 * | 10/2017 | E01C 19/48 |

(Continued)

*Primary Examiner* — Thomas B Will
*Assistant Examiner* — Katherine J Chu
(74) *Attorney, Agent, or Firm* — Bookoff McAndrews

(57) ABSTRACT

A screed assembly for a paving machine is disclosed. The screed assembly includes a screed plate having a front edge, a first plate positioned in front of the front edge of the screed plate. The first plate defining having a first thickness. A temperature sensor is coupled to the first plate. The temperature sensor is configured to determine a temperature of a paving material, whereby the temperature of the paving material is measured before the paving material comes into contact with the screed plate.

19 Claims, 6 Drawing Sheets

(56) References Cited

U.S. PATENT DOCUMENTS 6,203,243 B1 * 3/2001 Birtchet ..... E01C 19/42 404/104
6,334,735 B1 * 1/2002 Williams ..... E01C 19/48 404/79
6,550,214 B2 * 4/2003 Aguilera ..... E01C 19/42 15/144.1
6,769,836 B2 8/2004 Lloyd
6,805,516 B2 10/2004 Barnat et al.
6,981,820 B2 1/2006 Nelson
7,172,363 B2 * 2/2007 Olson ..... E01C 19/006 404/118
7,217,062 B2 * 5/2007 Pisano ..... E01C 19/48 404/77
7,470,082 B2 12/2008 Lloyd
7,651,296 B2 * 1/2010 Lindley ..... E01C 19/402 404/114
8,099,218 B2 * 1/2012 Glee ..... E01C 19/004 106/271
8,152,409 B1 * 4/2012 Ligman ..... E01C 19/006 404/118
8,297,875 B1 * 10/2012 Kopacz ..... E01C 19/48 404/118
8,454,266 B2 * 6/2013 Buschmann ..... E01C 19/4853 404/72
8,517,628 B2 8/2013 Weiser et al.
8,591,146 B2 11/2013 Begley et al.
8,636,442 B1 1/2014 Sopko, Jr. et al.
8,702,344 B2 * 4/2014 Hanfland ..... G01B 21/08 404/118
8,744,646 B2 6/2014 Buschmann et al.
8,807,866 B2 * 8/2014 Buschmann ..... E01C 19/407 404/74
8,930,092 B2 1/2015 Minich
8,967,908 B1 * 3/2015 Thieme ..... E01C 19/002 404/118
8,998,530 B2 4/2015 Buschmann et al.
9,011,038 B2 4/2015 Buschmann et al.
9,045,870 B2 * 6/2015 Buschmann ..... E01C 19/4866
9,068,295 B2 6/2015 Rutz et al.
9,481,964 B1 11/2016 Marsolek
9,611,595 B2 4/2017 Marsolek et al.
9,657,447 B2 * 5/2017 Mattson ..... E01C 23/24
9,811,952 B2 * 11/2017 Carlson ..... G07C 5/0808
9,845,578 B2 12/2017 Marsolek et al.
2002/0182009 A1 12/2002 Barnat et al.
2004/0260504 A1 12/2004 Bienvenu et al.
2006/0080442 A1 4/2006 Ferguson et al.
2007/0050137 A1 3/2007 Woon et al.
2008/0249729 A1 10/2008 Martinez et al.
2009/0142133 A1 6/2009 Glee et al.
2009/0257825 A1 * 10/2009 Nelson ..... E01C 19/48 404/95
2010/0178107 A1 7/2010 Braddy et al.
2010/0283598 A1 11/2010 King et al.
2012/0087726 A1 4/2012 Smieja
2012/0288328 A1 11/2012 Minich
2013/0124010 A1 5/2013 Olson et al.
2013/0136539 A1 5/2013 Aardema
2013/0290062 A1 10/2013 Patel et al.
2014/0363231 A1 12/2014 Bartoszek
2015/0003914 A1 1/2015 Steinhagen et al.
2016/0245785 A1 * 8/2016 Marsolek ..... E01C 19/22

FOREIGN PATENT DOCUMENTS

EP 0667415 B1 3/1999
EP 1566484 A1 * 8/2005 ..... E01C 19/48
JP 2011-132761 A 7/2011

* cited by examiner

SCREED ASSEMBLY FOR A PAVING MACHINE

TECHNICAL FIELD

The present disclosure relates generally to a paving machine, and more particularly to a screed assembly of the paving machine having a temperature sensor to monitor temperature of paving material.

BACKGROUND

When building roadways, parking lots and the like, paving machines are used to deposit paving material, such as asphalt, on a paving surface to create a flat, consistent surface over which vehicles may travel. The paving machine typically works with a compactor to create a finished mat surface. The paving machine is generally a self-propelled machine designed to receive, convey, distribute, and partly compact the paving material. Typically, the paving machine receives heated paving material in a hopper positioned at a front of the paving machine, conveys the paving material from the hopper to a rear of the paving machine with conveyors, distributes the paving material along a desired width with an auger, and forms the paving material into a mat with a screed assembly. The mat is further compacted by one or more compactors.

One or more compactors generally follow behind a paver and compact the mat to a desired degree or extent. The compactor may include a drum assembly having a vibratory mechanism. Both amplitude and frequency of vibration may be controlled to establish degree of compaction.

The extent of compaction effort mainly depends on the temperature of the paving material. For example, if sections of the mat are at a lower than preferred temperature, the one or more compactors may have to make additional passes across these sections to ensure sufficient compaction. On the other hand, if sections of the formed mat are at a higher than preferred temperature, compactor operators will have to take caution to avoid over compacting these sections. Therefore, for laying a good finished mat, temperature of the paving material is significant for proper compaction by the screed assembly and thereafter by one or more compactors that follow the paving machine.

Current systems include temperature scanning devices and infrared cameras mounted to the screed assembly to scan and determine the surface temperature of the mat surface formed by the screed assembly. These systems measure the surface temperature of the mat surface laid down by the screed assembly. The surface temperature of the mat surface may be different from the core temperature of the paving material. Further, these systems may be expensive.

US Patent Application Publication No. 20150003914 discloses a temperature sensor configured to determine the temperature of the screed plate. The screed plate has a top surface, a thickness, and an opening in the top surface. The opening extends into the thickness of the screed plate and receives at least a portion of the temperature sensor. The temperature sensor monitors the temperature of the screed plate and based on the temperature of the screed plate a controller adjusts the heating of the screed plate.

However, measuring the temperature of a screed plate may not provide an accurate measurement of the temperature of the paving material that is needed to control the compaction process.

SUMMARY OF THE INVENTION

In an aspect of the present disclosure, a screed assembly for a paving machine is disclosed. The screed assembly includes a screed plate having a front edge, a first plate having a first thickness. The first plate is positioned in front of the front edge of the screed plate. At least one temperature sensor is coupled to the first plate. The temperature sensor is configured to determine a temperature of a paving material, whereby the temperature of the paving material is measured before the paving material comes into contact with the screed plate.

In another aspect of the present disclosure, a paving system is disclosed. The paving system includes a paving machine, a compactor and a controller. The compactor is configured to apply a variable compaction effort to a paving material. The paving machine includes a screed plate having a front edge, a first plate is positioned in front of the front edge of the screed plate. The first plate has a first thickness and a temperature sensor is coupled to the first plate and positioned at least partly within the first thickness and configured to determine a temperature of the paving material, whereby the temperature of the paving material is measured before the paving material comes into contact with the screed plate. The controller is configured receive a temperature data from the temperature sensor and control the variable compaction effort of the compactor based on the temperature data.

In yet another aspect of present disclosure, a method for paving a ground surface is disclosed. The method includes providing a paving machine having a first plate in front of a front edge of a screed plate. The first plate has a temperature sensor configured to provide temperature of a paving material, whereby the temperature of the paving material is measured before the paving material comes into contact with the screed plate, providing a compactor applying a variable compaction effort to the paving material, providing the temperature of the paving material to the compactor and adjusting the variable compaction effort of the compactor based on the temperature of the paving material.

DETAILED DESCRIPTION

Reference will now be made in detail to the embodiments of the disclosure, examples of which are illustrated in the accompanying drawings. Wherever possible, the same reference number will be used throughout the drawings to refer to the same or like parts.

Figure 1:
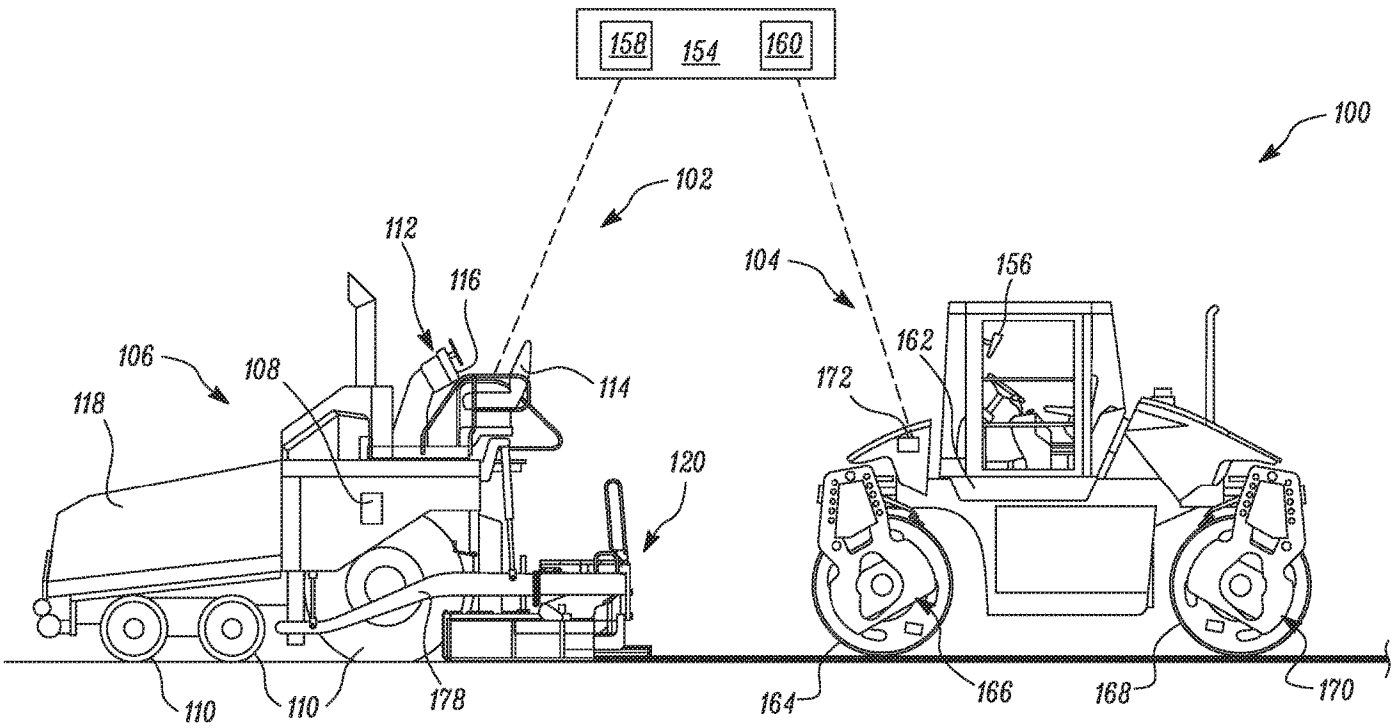
FIG. 1 illustrates a paving system including a paving machine and a compactor.

An exemplary embodiment of a paving system 100 is shown in FIG. 1. The paving system 100 includes a paving machine 102, a compactor 104 and a controller 154. Although the paving machine 102 is depicted in the figures as an asphalt paver, the paving machine 102 may be any kind of paving machine configured to form a layer of paving material on a ground surface. The paving machine 102 includes a tractor 106 having a power source 108, such as an internal combustion engine, one or more traction devices 110 and a hopper 118. The traction devices 110 may be operatively coupled to the power source 108 by a transmission mechanism (not shown) to drive the traction devices 110 and propel the paving machine 102. Although, the traction devices 110 are shown in the figures as wheels, the traction devices 110 could alternatively be tracks or any other type of traction devices. The traction devices 110 could also be combinations of different types of traction devices. For example, the paving machine 102 could include both tracks and wheels. The paving machine 102 also includes an operator station 112 for one or more operators. The operator station 112 includes one or more operator seat 114 and an operation console 116 that may be mounted on a pedestal.

The hopper 118 is positioned at the front of the paving machine 102 and contains the paving material that is to be formed into a mat on the ground. The paving material may be dumped into the hopper 118 from trucks that deliver the paving material to a work site. The paving machine 102 may also include one or more conveyors (not shown) at the bottom of the hopper 118. The conveyors transport the paving material from the hopper 118 to the rear of the tractor 106. The paving machine 102 may further include one or more augers or other material feed components instead of or in addition to the conveyors. The augers distribute the paving material in front of a screed assembly 120. As the paving machine 102 travels forward, the paving material is evenly spread and compacted by the screed assembly 120.

Figure 2:
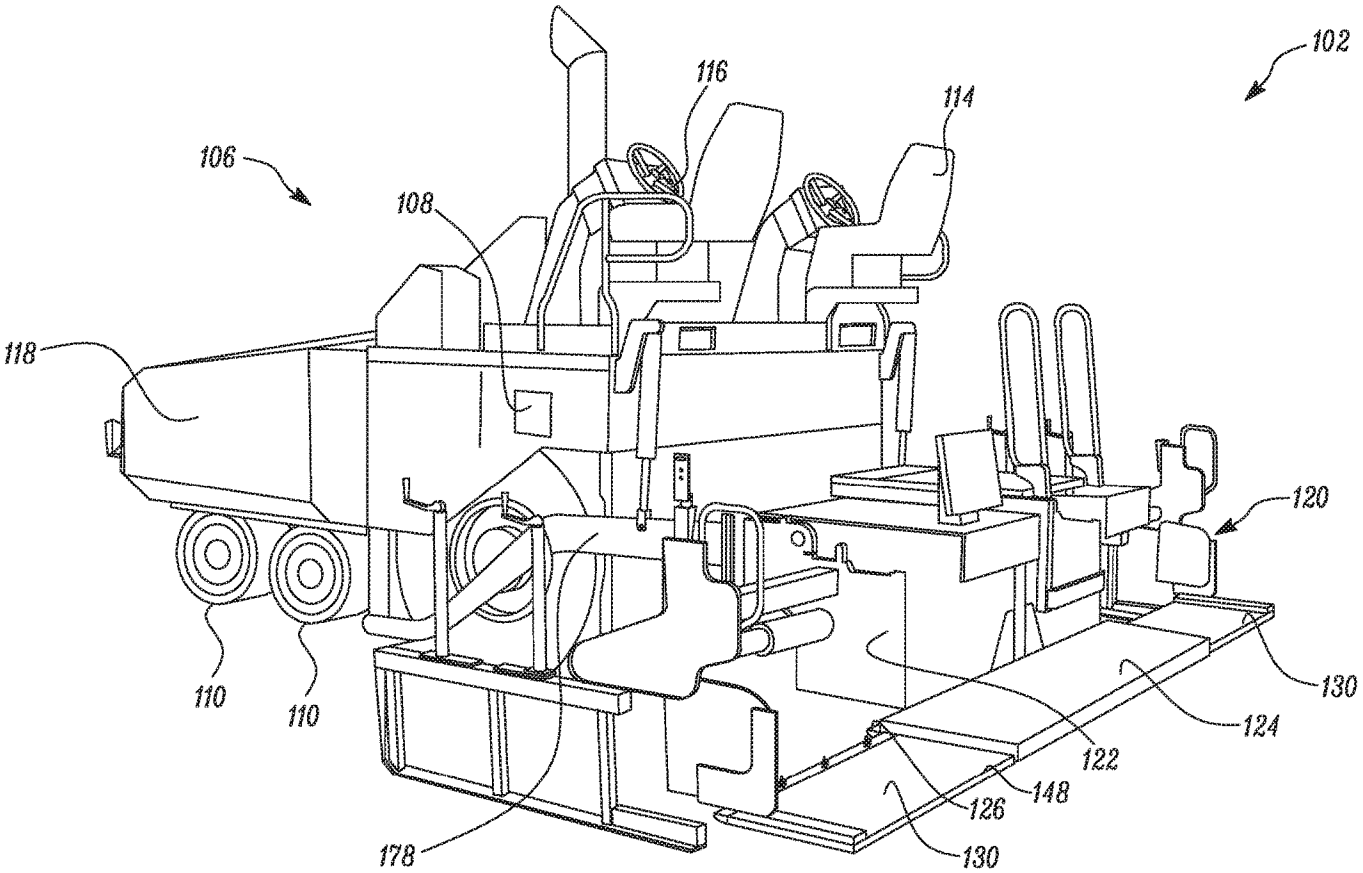
FIG. 2 illustrates a perspective view of the paving machine depicting a screed assembly.
Figure 3:
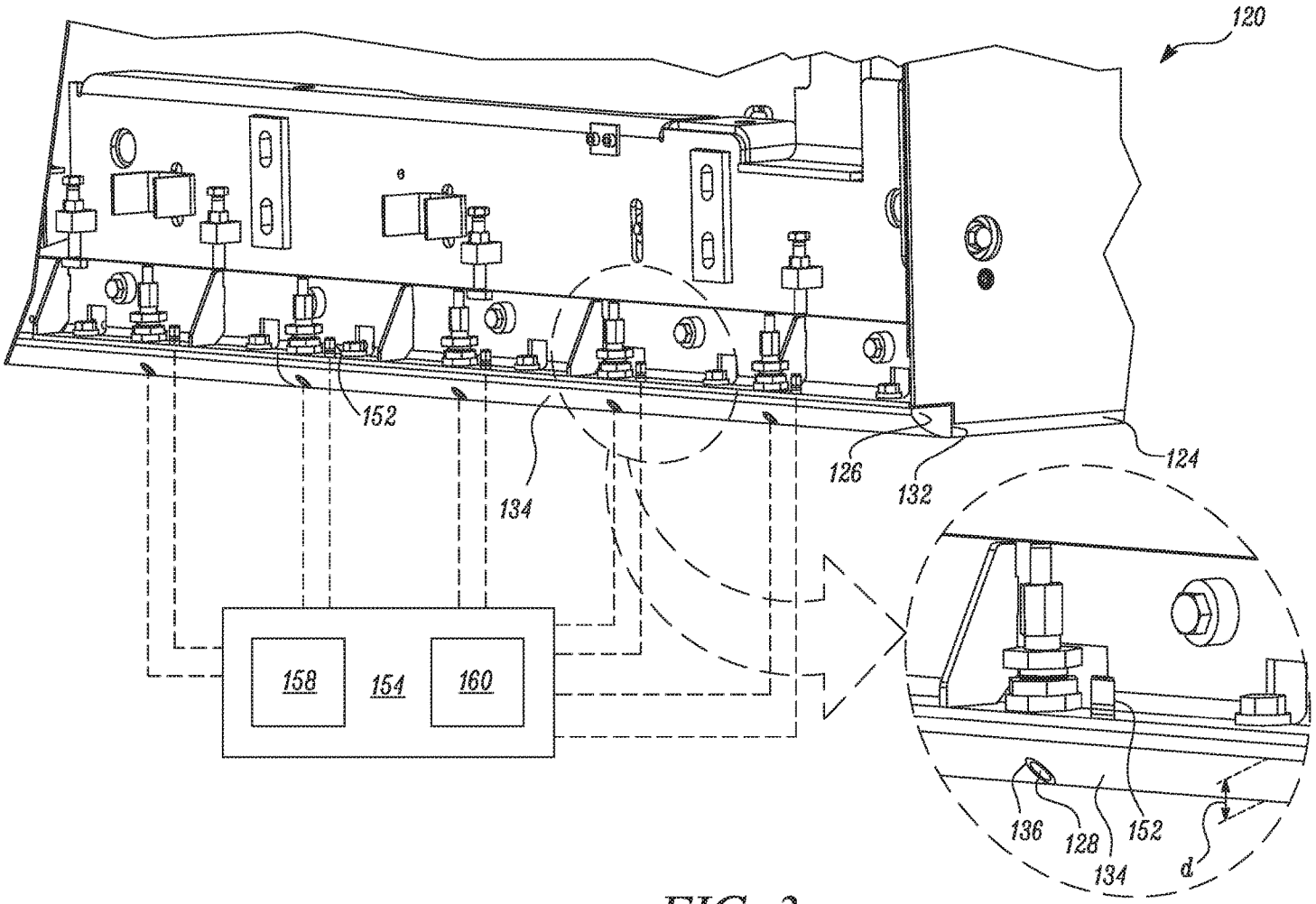
FIG. 3 illustrates a perspective view of the screed assembly having a first plate.

The screed assembly 120 is positioned at the rear end of the tractor 106. The screed assembly 120 is attached to the tractor 106 by tow arms 178 and towed behind the tractor 106 to spread and compact the paving material into the mat on the ground surface. Referring to FIG. 2 and FIG. 3, the screed assembly 120 includes a frame 122, a screed plate 124, a first plate 126, one or more temperature sensors 128, and one or more extender plates 130. The screed plate 124 is supported by the frame 122. The screed plate 124 has a front edge 132. The first plate 126 is positioned in front of the front edge 132 of the screed plate 124. The first plate 126 may be attached with the screed plate 124 by welding, press fitting or any other method known in art. In an alternate embodiment, the first plate 126 may be coupled with the frame 122, such that the first plate 126 is positioned in front of the screed plate 124. In the embodiment illustrated, the first plate 126 is a nose bar. The nose bar may be coupled adjacent to the front edge 132 of the screed plate 124. The nose bar is configured to guide the paving material under the screed plate 124. The nose bar may also pre-compact the paving material prior to the screed plate 124.

Referring to FIG. 3, the first plate 126 may define a surface profile 134, configured to pre-compact the paving material and guide the paving material to the screed plate 124 for further compaction. The first plate 126 further defines an opening 136 extending from the surface profile 134 into a first thickness 'd' of the first plate 126. In the embodiment illustrated, plurality of openings 136 may extend from the surface profile 134 into the first thickness 'd' of the first plate 126. The openings 136 may be bores that extend completely through the first plate 126. In an embodiment, the openings 136 are blind bores extending partially into the first thickness 'd' from the surface profile 134 of the first plate 126. The openings 136 are configured to receive the temperature sensor 128 within the first thickness 'd'.

Figure 4:
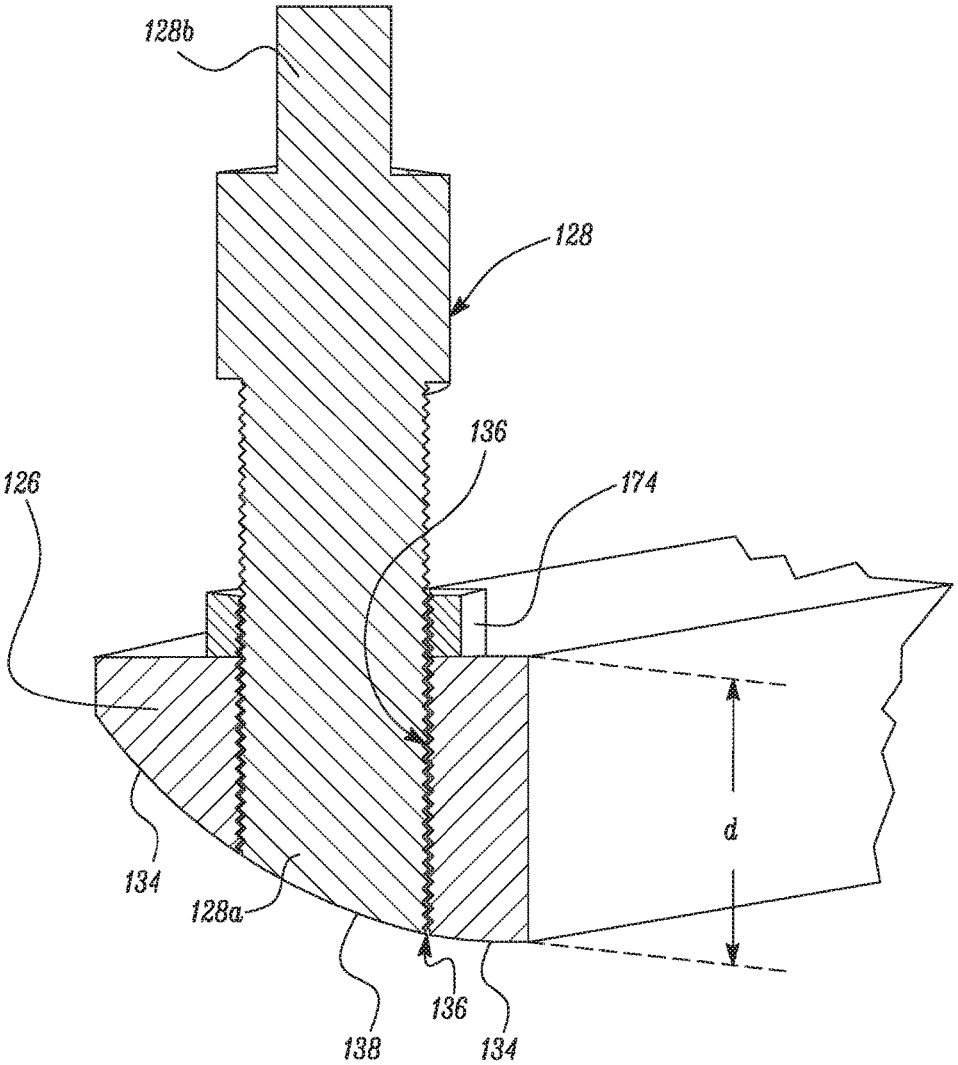
FIG. 4 illustrates a sectional view of the first plate including a temperature sensor.

In the embodiment illustrated, the temperature sensor 128 is positioned at least partly into the first thickness 'd' of the first plate 126. In an alternate embodiment, the temperature sensor 128 may be positioned completely into the first thickness 'd' of the first plate 126. The temperature sensor 128 is configured to measure the temperature of the paving material before the paving material comes into contact with the screed plate 124. Referring to FIG. 4, the temperature sensor 128 defines a main body portion 128*a* and a cap portion 128*b*. The main body portion 128*a* defines a surface having an outer surface profile 138. The outer surface profile 138 is configured to contact the paving material to determine the temperature of the paving material.

When engaged with the first plate 126, the outer surface profile 138 of the temperature sensor 128 may be substantially flush with the surface profile 134 of the first plate 126 and forms a continuous surface profile i.e. the first plate 126 and the temperature sensor 128 are simultaneously in contact with the paving material. In an aspect of the present disclosure, plurality of temperature sensors 128 may be coupled to the first plate 126 and positioned at least partly within the first thickness 'd'. The plurality of temperature sensors 128 may be positioned at predefined locations on the first plate 126. The plurality of temperature sensors 128 are positioned to determine the temperature of the paving material along the complete width of the mat.

The temperature sensor 128 may be a "contact" type of temperature sensor, such as, for example, a thermocouple with a sensing junction, a thermostat, resistive temperature detectors (RTD) or any other temperature sensing device known in art. In an embodiment, the temperature sensor 128 may be made of a high heat conductive material such as aluminum or any other material with high heat conductivity. The high heat conductive material is configured to contact and determine the temperature of the paving material when it reaches the screed assembly 120.

Figure 5:
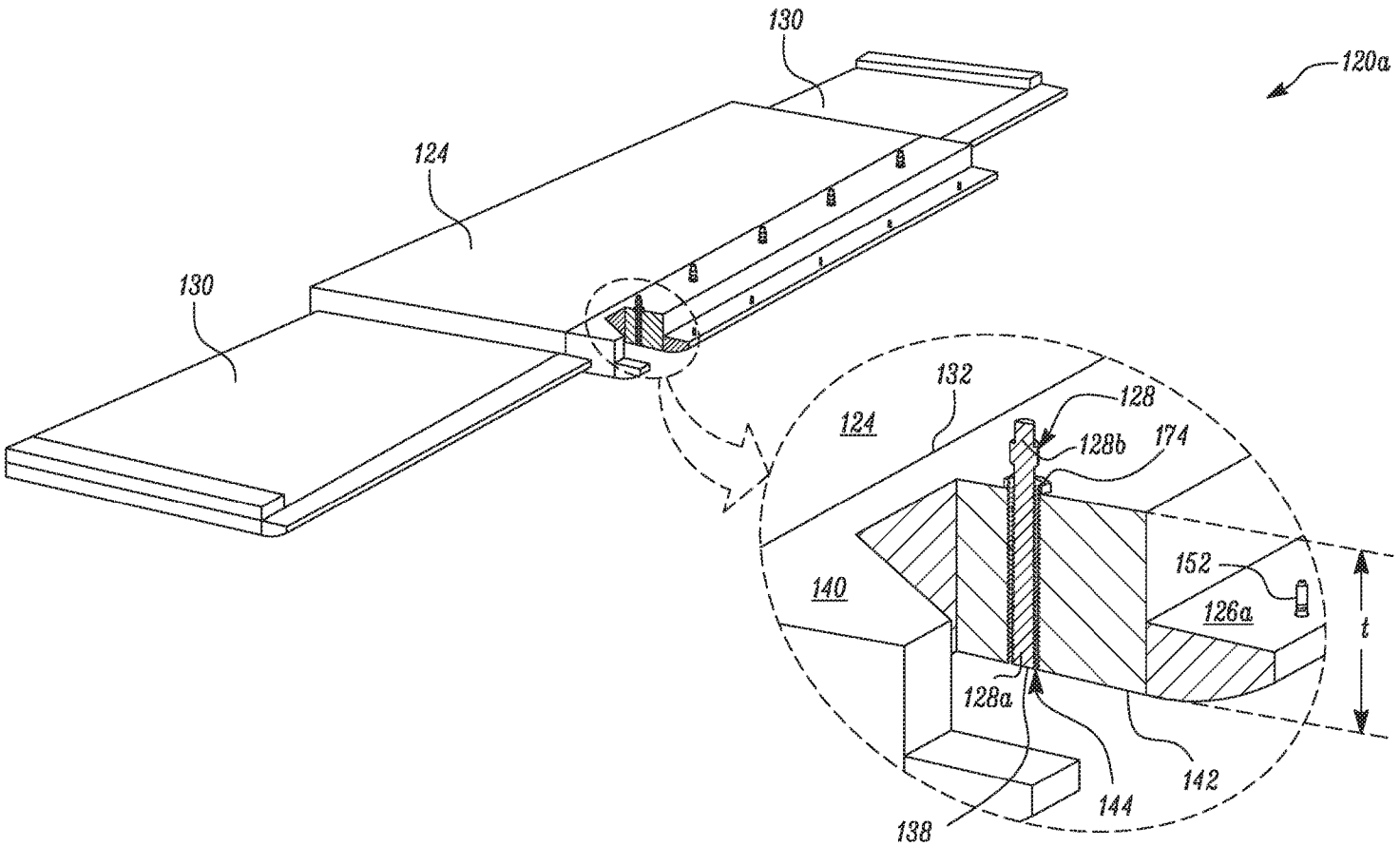
FIG. 5 illustrates an enlarged cut away view of a screed assembly having a second plate.

In an alternate embodiment, as illustrated in FIG. 5, a screed assembly 120*a* may include a first plate 126*a* and a second plate 140. The second plate 140 is disposed between the first plate 126*a* and the front edge 132 of the screed plate 124. The second plate 140 is arranged such that the paving material comes in contact with the second plate 140 before compaction by the screed plate 124. The second plate 140 may define a second thickness 't'. The second plate 140 may further define a second surface profile 142. The second plate 140 has a second plate opening 144 extending from the second surface profile 142 into the second thickness 't' of the second plate 140. The temperature sensor 128 is positioned at least partly within the second thickness 't' of the second plate 140. The temperature sensor 128 is configured to measure the temperature of the paving material before the paving material comes into contact with the screed plate 124. The outer surface profile 138 of the temperature sensor 128 may be substantially flush with the second surface profile 142 of the second plate 140 i.e. the second plate 140 and the temperature sensor 128 are simultaneously in contact with the paving material. In an embodiment, both the first plate 126*a* and the second plate 140 may include at least one temperature sensor 128.

Figure 6:
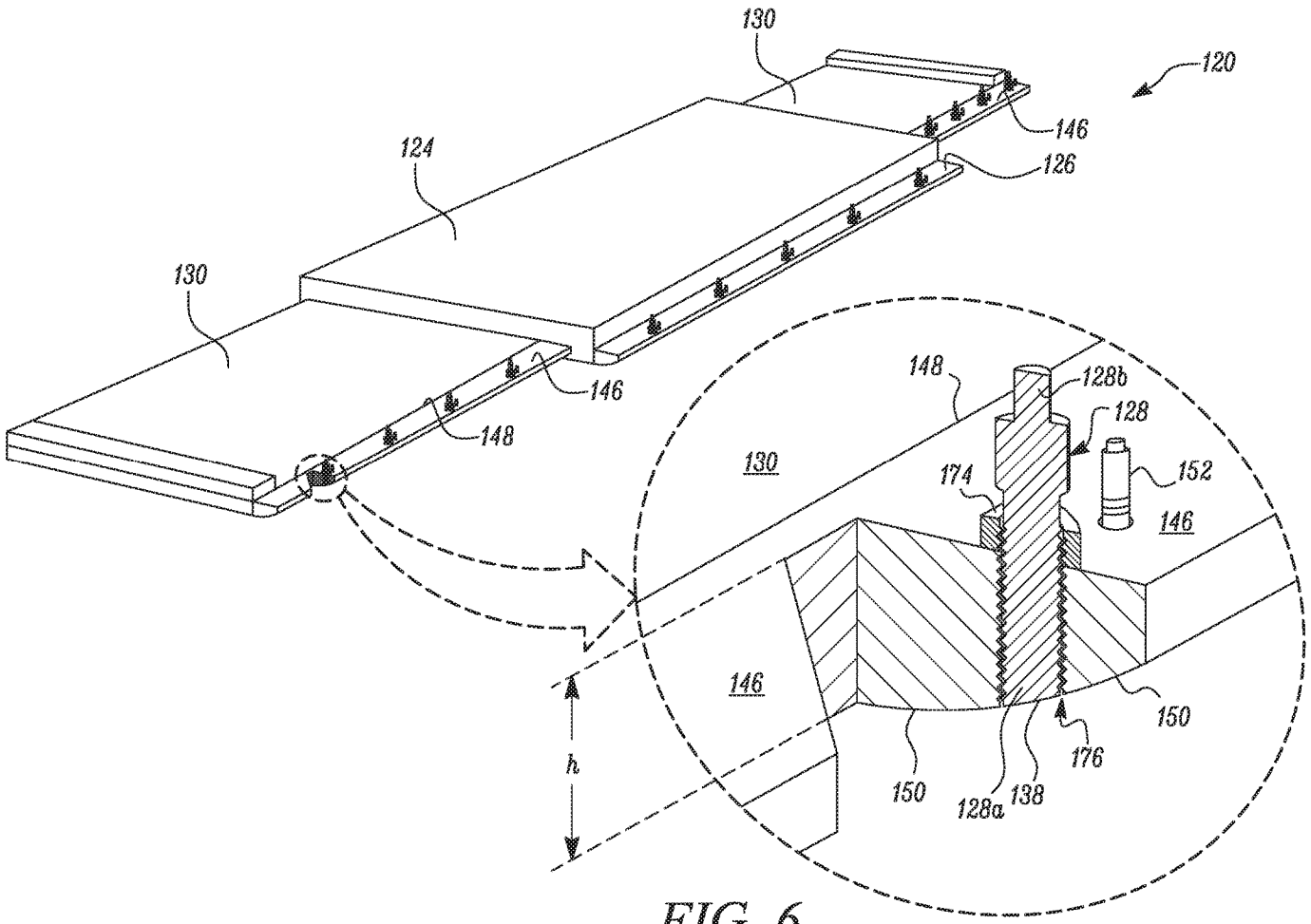
FIG. 6 illustrates an enlarged cut away view of the screed assembly having a third plate.

In another embodiment, illustrated in FIG. 6, the screed assembly 120 may include a third plate 146. The third plate 146 is disposed in front of an edge 148 of the extender plate 130. The edge 148 is located in front of the extender plate 130. In an embodiment, the third plate 146 may be a tamper bar configured to pre-compact the paving material. In an alternate embodiment, the third plate 146 may be a nose bar. The third plate 146 may define a third thickness 'h'. The third plate 146 may further define a third surface profile 150. The third plate 146 has a third plate opening 176 extending from the third surface profile 150 into the third thickness 'h' of the third plate 146. At least one temperature sensor 128 may be positioned at least partly within the third thickness 'h' of the third plate 146. The temperature sensor 128 is configured to measure the temperature of the paving material before the paving material comes into contact with the extender plate 130. The outer surface profile 138 of the temperature sensor 128 may be substantially flush with the third surface profile 150 of the third plate 146 i.e. the third plate 146 and the temperature sensor 128 are simultaneously in contact with the paving material.

The temperature sensor 128 may be mounted to the first plate 126, the second plate 140 or the third plate 146 using methods known in the art including welding, press fitting or by threaded engagement. Referring to the embodiments illustrated in FIG. 4, FIG. 5 and FIG. 6, the openings 136, the second plate openings 144 and the third plate openings 176 may have threads. The temperature sensor 128 may have complementary threads to secure the temperature sensor 128 within one or more of the opening 136, the second plate opening 144 and the third plate opening 176 extending into the first thickness 'd', the second thickness T and the third thickness 'h' respectively. In an illustration of the present embodiment, the temperature sensor 128 may be a threaded insert. The screed assembly 120 may further include a lock nut 174 for securing the temperature sensor 128 to the first plate 126, the second plate 140 and/or third plate 146.

In an alternate embodiment, a high heat conductive insert may be coupled with the temperature sensor 128 disposed on the first plate 126, the second plate 140 and/or the third plate 146. For example, the high heat conductive insert is positioned within the opening 136 extending into the first thickness 'd' of the first plate 126. The temperature sensor 128 is coupled to the high heat conductive insert. The high heat conductive insert prevents the wearing of the temperature sensor 128.

In yet another embodiment, the screed plate 124 may further include multiple screed plate openings towards the front of the screed plate 124. The temperature sensor 128 with a thermal insulator may be positioned in the screed plate openings. The thermal insulator is configured to limit the heat transfer from the screed plate 124 to the temperature sensor 128.

In an embodiment, the surface profile 134 of the first plate 126, the second surface profile 142 of the second plate 140 and the third surface profile 150 of the third plate 146 may be different. In an alternate embodiment, the surface profile 134 of the first plate 126, the second surface profile 142 of the second plate 140 and the third surface profile 150 of the third plate 146 may be identical to each other. Further, the first plate 126, the second plate 140 and the third plate 146 may have same thickness i.e. the thickness 'd', thickness 't' and thickness 'h' are same. In another embodiment, the first plate 126, the second plate 140 and the third plate 146 may have different thickness i.e. the thickness 'd', thickness T and thickness 'h' are different.

As shown in FIG. 3, the screed assembly 120 may further include plurality of position detectors 152. The position detector 152 may be configured to provide location of the screed plate 124 or any of its other associated component. The position detector 152 may be any one or a combination of a Global Positioning System (GPS), an Inertial Navigation System or any other known position detection system known in the art. The position detector 152 may also receive or determine the positional information associated with the temperature sensor 128. The positional information from the position detector 152 and a temperature data from the temperature sensor 128 are transmitted to the controller 154 (shown in FIG. 1) for further processing.

Referring to FIG. 1 and FIG. 3, the controller 154 may be communicably coupled with the temperature sensor 128, the position detector 152, the paving machine 102 and the compactor 104. In illustration of present embodiment, the controller 154 is located at a remote location. In alternative embodiments, the controller 154 is disposed on the paving machine 102 or on the compactor 104. In another embodiment, the controller 154 may be located at a remote location. The controller 154 may be a microprocessor or any other electronic device to control a plurality of devices. In an embodiment, the controller 154 may be an electronic control module (ECM). The controller 154 may be configured to receive signals from various devices, but not limited to, the temperature sensor 128 and the position detector 152. In an alternate embodiment, the controller 154 may also be configured to transmit signals to various devices, but not limited to, a display unit 156. The controller 154 further includes a memory unit 158 and a processing unit 160.

The memory unit 158 may include one or more storage devices configured to store information used by the controller 154 to perform certain functions related to the present disclosure. The processing unit 160 may include one or more known processing devices, such as a microprocessor or any other device known in the art. In the embodiment illustrated, the memory unit 158 and processing unit 160 may be included together in a single unit. In an alternate embodiment, the memory unit 158 and the processing unit 160 may be incorporated separately.

The controller 154 may store a standard temperature data for the paving material. In the embodiment illustrated, the standard temperature data refers to the temperature of the paving material at which a proper finished mat is created on the ground surface. In an alternate embodiment, the memory unit 158 may also store an algorithm to compare the temperature data received from the temperature sensor 128 with the standard temperature requirement.

The controller 154 receives the temperature of the paving material from the temperature sensor 128. The controller 154 is configured to control temperature of the screed plate 124 according to the temperature data received from the temperature sensor 128, for example, if the temperature of the paving material is lower than the standard temperature, then the controller 154 may transmit signal to increase the temperature of heating elements present in the screed plate 124. The controller 154 further receives the positional data of the temperature sensors 128 from the position detectors 152. The sensed position data output from the position detector 152 and the temperature data from the temperature sensor 128 may be recorded onto high capacity discs or cards (not shown) for maintaining a historical record of the thermal profile of the mat surface as laid.

The processing unit 160 utilizes information from the position detector 152 and the temperature sensor 128 to formulate a heat map of the ground surface. The heat map indicates the temperature of the paving material at various locations on the ground surface. Further, the controller 154 may transmit the temperature data, the positional data or the heat map to the compactor 104.

The compactor 104 is configured to compact soil, gravel, concrete, or asphalt in the construction of roads and foundations. As illustrated in FIG. 1, the compactor 104 includes a compactor frame 162, having a front compacting drum 164 and a back compacting drum 168 coupled therewith. In an embodiment, the front compacting drum 164 may include a front vibratory apparatus 166 associated therewith, whereas the back compacting drum 168 may also include a back vibratory apparatus 170 associated therewith. The compactor 104 applies variable compaction efforts to the paving material for further compaction after the ground surface is paved by the paving machine 102.

In an illustration of the present embodiment, the compactor 104 may include a receiver 172. The receiver 172 is configured to receive compactor control commands from the controller 154 based on the temperature data. In an embodiment, the controller 154 may control the variable compaction efforts of the compactor 104 based on the positional data associated with the temperature data. Therefore, the compaction effort of the compactor 104 may be varied based on the different temperatures of the paving material associated with different locations. This helps in ensuring proper compaction of the paving material along the entire mat. The receiver 172 further generates control commands for the front vibratory apparatus 166 and the back vibratory apparatus 170 to vary the compaction efforts i.e. changing energy transfer between compactor 104 and the mat. The front vibratory apparatus 166 and the back vibratory apparatus 170 may have an adjustable vibration amplitude, adjustable vibration frequency and/or adjustable vibration direction. Varying energy transfer could also include turning one or both of front vibratory apparatus 166 and back vibratory apparatus 170 on or off. In an embodiment, the heat map is transmitted to the display unit 156 disposed in the compactor 104.

The controller 154 may be communicably coupled to the display unit 156. In an embodiment, the display unit 156 may be remotely connected with the controller 154. In an alternate embodiment, the display unit 156 may be in communication with the controller 154 using a wire. In another embodiment, the display unit 156 may be any portable device which may be operated by a personnel present outside the paving system 100. The display unit 156 may be configured to display the temperature data from the controller 154. The display unit 156 may also be configured to display the heat map generated by the controller 154. The display unit 156 may be included in the paving machine 102. In an alternate embodiment, the display unit 156 may be positioned in the central station for remotely controlled machines. In an embodiment, the operator may also manually adjust the compaction efforts of the compactor 104 according to the heat map.

INDUSTRIAL APPLICABILITY

In operation, the paving machine 102 receives the paving material in the hopper 118, positioned in front of the paving machine 102. The augers conveys the paving material from the hopper 118 to the rear of the machine with conveyors and distributes the paving material along a desired width. The screed assembly 120 includes the temperature sensor 128, positioned partly within the thickness of the first plate 126 to measure the temperature of the paving material before it comes in contact with the screed plate 124. The first plate 126 pre-compacts the paving material and guides the paving material to the screed plate 124. During paving operations, it is important to receive accurate readings of the temperature of the paving material when it first comes in contact with the screed plate 124. Further, it is also useful to determine the temperature of the paving material prior to the compaction process by the compactor 104. The compactor 104 applies variable compaction effort on the mat of paving material formed by the screed plate 124 based on the temperature of the paving material. The determined temperature of the paving material is transmitted to the controller 154. The controller 154 may control the temperature of the heating elements present in the screed plate 124 according to the temperature of the paving material. The heating of the screed plate 124 helps in better shaping and spreading of the paving material during paving process by the paving machine 102, when the temperature of the paving material is less than a desired temperature. The controller 154 further generates the heat map of the mat and transmit the heat map to the compactor 104. The controller 154 controls the variable compaction effort of the compactor 104 according to the heat map and the temperature data. The compaction effort may be varied by varying amplitude and frequency of the vibration of the front vibratory apparatus 166 and/or the back vibratory apparatus 170. Additionally, the controller 154 may also give instructions to one or more compactors 104 to make additional passes to for desirable compaction of the paving material.

Compaction effort necessary to obtain desired degree of compaction depends on the temperature of the paving material. As the temperature sensor 128 provides correct temperature of the paving material, the variable compaction effort of the compactor 104 is controlled. This helps in preventing over compaction or less than optimal compaction of the paving material and thereby ensuring good quality of mat surface. Thus, determination of accurate temperature value of the paving material improves the compaction process and results in the proper finished mat surface.

Further, as the plurality of temperature sensors 128 are provided, the controller 154 continue to receive the temperature data of the paving material when one or more of the plurality of temperature sensors 128 fail. Thereby, ensuring smooth functioning of the paving system 100 and proper compaction of the mat surface.

While aspects of the present disclosure have seen particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A screed assembly for a paving machine comprising:

a screed plate having a front edge;

a first plate positioned in front of the front edge, the first plate having a first thickness;

a second plate disposed between the first plate and the screed plate, the second plate having a second thickness;

a temperature sensor provided within the second plate, the temperature sensor having an end face provided between the screed plate and an angled surface of the first plate and configured to determine a temperature of a paving material, whereby the temperature of the paving material is measured before the paving material comes into contact with the screed plate.

2. The screed assembly of claim 1, wherein the temperature sensor is communicably coupled to a controller, the controller configured to control a temperature of the screed plate based on a temperature data received from the temperature sensor.

3. The screed assembly of claim 1, wherein the temperature sensor is communicably coupled to a controller, the controller configured to control a compactor based on a temperature data received from the temperature sensor.

4. The screed assembly of claim 1, wherein a heat map is generated, by a controller, based on a temperature data received from the temperature sensor.

5. The screed assembly of claim 1, wherein the second plate defines a surface profile, the temperature sensor defining an outer surface profile, the outer surface profile of the temperature sensor substantially flush with the surface profile of the second plate.

6. The screed assembly of claim 1, further comprising:
an extender plate having an edge;
a third plate positioned in front of the edge of the extender plate;
a third plate temperature sensor partly positioned within a third thickness of the third plate; and
a position detector coupled to the third plate.

7. A paving system comprising:
a compactor configured to apply a variable compaction effort to a paving material; and
a paving machine comprising:
a screed plate having a front edge;
a first plate positioned in front of the front edge, the first plate having a first thickness;
a second plate positioned to contact the paving material before the screed plate, the second plate having a second thickness;
a temperature sensor disposed within the first plate and positioned at least partly within the first thickness, the temperature sensor having an angled end face substantially flush with an angled surface of the first plate, the temperature sensor configured to determine a temperature of the paving material, whereby the temperature of the paving material is measured before the paving material comes into contact with the screed plate; and
a controller communicably coupled to the temperature sensor and configured to:
receive a temperature data from the temperature sensor; and
control the variable compaction effort of the compactor based on the temperature data.

8. The paving system of claim 7, wherein the controller further receives a position data associated with the temperature data from a position detector and controls the variable compaction effort based on the position data and the associated temperature data.

9. The paving system of claim 7, wherein the controller is configured to generate a heat map of a ground surface.

10. The paving system of claim 7, wherein the temperature sensor is positioned so as to extend beyond the first thickness of the first plate in a direction away from the angled surface of the first plate.

11. The paving system of claim 7, further comprising:
an extender plate having a front edge;
a third plate in front of an edge of the extender plate; and
a third plate temperature sensor partly positioned within a third thickness of the third plate; and
a position detector coupled to the third plate.

12. A screed assembly for a paving machine comprising:
a screed plate having a front edge;
a first plate positioned in front of the front edge, the first plate forming a nose bar;
a second plate disposed between the first plate and the screed plate, the second plate having a second thickness;
an extender plate having an edge;
a third plate in front of the edge of the extender plate, the third plate having a third thickness;
a first temperature sensor positioned in the second plate to be flush with a bottom surface of the second plate to contact a paving material during use to determine a first temperature of the paving material, whereby the first temperature of the paving material is measured before the paving material comes into contact with the screed plate; and
a second temperature sensor positioned in the third thickness of the third plate, the second temperature sensor configured to determine a second temperature of the paving material before the paving material comes into contact with the extender plate.

13. The screed assembly of claim 12, wherein the first plate is secured to the second plate, and the second plate is secured to the screed plate.

14. The screed assembly of claim 12, wherein the screed plate comprises heating elements, and wherein the heating elements, the first temperature sensor, and the second temperature sensor are communicably coupled to a controller, the controller configured to control a temperature of the heating elements based on a temperature data received from the first temperature sensor and the second temperature sensor.

15. The screed assembly of claim 12, wherein the first temperature sensor and the second temperature sensor are communicably coupled to a controller, the controller configured to control a compactor based on a temperature data received from the first temperature sensor and the second temperature sensor.

16. The screed assembly of claim 12, further comprising a position detector, wherein the first temperature sensor, the second temperature sensor, and the position detector are communicably coupled to a controller, the controller configured to formulate a heat map of a ground surface.

17. The screed assembly of claim 16, wherein the position detector is coupled to the first plate.

18. The screed assembly of claim 1, wherein the angled surface of the first plate includes a curved surface.

19. The screed assembly of claim 7, wherein the angled surface of the first plate includes a curved surface that extends from a substantially flat front surface of the first plate.

* * * * *